US006677275B1

(12) United States Patent
Midorikawa et al.

(10) Patent No.: US 6,677,275 B1
(45) Date of Patent: Jan. 13, 2004

(54) THERMAL RECORDING MATERIAL

(75) Inventors: Yoshimi Midorikawa, Tokyo (JP); Naomi Sumikawa, Tokyo (JP); Kaoru Hamada, Tokyo (JP); Yoshihide Kimura, Tokyo (JP); Toshio Kaneko, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 09/674,310

(22) PCT Filed: Mar. 3, 2000

(86) PCT No.: PCT/JP00/01300

§ 371 (c)(1),
(2), (4) Date: Oct. 31, 2000

(87) PCT Pub. No.: WO00/53426

PCT Pub. Date: Sep. 14, 2000

(30) Foreign Application Priority Data

Mar. 5, 1999 (JP) ..... 11/058115
May 31, 1999 (JP) ..... 11/151597
May 28, 1999 (JP) ..... 11/149467

(51) Int. Cl.[7] ..... B41M 5/20; B41M 5/24
(52) U.S. Cl. ..... 503/216; 503/209; 503/217; 503/221
(58) Field of Search ..... 503/209, 216, 503/217, 221

(56) References Cited

U.S. PATENT DOCUMENTS 5,066,634 A * 11/1991 Minami et al. ..... 503/209
5,206,209 A * 4/1993 Minami et al. ..... 503/209
5,801,288 A 9/1998 Fuji et al. ..... 568/33
6,037,308 A 3/2000 Sato et al. ..... 503/216

FOREIGN PATENT DOCUMENTS

EP 0769391 4/1997
EP 0 778 157 6/1997

OTHER PUBLICATIONS

Patent Abstract of Japan, Japanese Patent Office, Publ. No. 08156415, date of publication of application Jun. 18, 1996.
Patent Abstract of Japan, Japanese Patent Office, Publ. No. 08295078, date of publication of application Nov. 12, 1996.
Patent Abstract of Japan, Japanese Patent Office, Publ. No. 08142523, date of publication of application Jun. 4, 1996.
Patent Abstract of Japan, Japanese Patent Office, Publ. No. 08142524, date of publication of application Jun. 4, 1996.
Patent Abstract of Japan, Japanese Patent Office, Publ. No. 05286255, date of publication of application Nov. 2, 1993.
Patent Abstract of Japan, Japanese Patent Office, Publ. No. 56040587, date of publication of application Apr. 16, 1981.
Patent Abstract of Japan, Japanese Patent Office, Publ. No. 09207443, date of publication of application Aug. 12, 1997.
Patent Abstract of Japan, Japanese Patent Office, Publ. No. 09076633, date of publication of application Mar. 25, 1997.
Patent Abstract of Japan, Japanese Patent Office, Publ. No. 10264526, date of publication of application Oct. 6, 1998.
Patent Abstract of Japan, Japanese Patent Office, Publ. No. 10236003, date of publication of application Sep. 8, 1998.

* cited by examiner

*Primary Examiner*—B. Hamilton Hess
(74) *Attorney, Agent, or Firm*—Sherman & Shalloway

(57) ABSTRACT

A thermally recording sheet which has high sensitivity in color development, satisfactory background heat resistance, and a satisfactory background color. The sheet contains a dihydroxydiphenylsulfone compound represented by general formula (1) as a color developer and a sulfonamide represented by general formula (2). In the formula, $R_1$ and $R_2$ each represents $C_{1-8}$ alkyl, alkenyl, or halogeno; and a and b each is an integer of 0 to 3. In the formula, $R_3$ represents $C_{1-66}$ alkyl or electron-attracting group; and n is an integer of 0 to 2.

(1)

(2)

9 Claims, No Drawings

THERMAL RECORDING MATERIAL

FIELD OF THE INVENTION

The present invention relates to a thermal recording material that has good color developing sensitivity, strong resistance to heat and good ground color.

DESCRIPTION OF THE PRIOR ART

In general, a thermal recording material having a thermally sensitive color developing layer mainly composed of colorless or pale colored dye precursor and color developing agent that develops color by reacting with said dye precursor when heated is disclosed in Japanese patent publication 45-14039 and widely used in commercial scale. A thermal printer in which a thermal head is installed is used for the recording method of said thermal recording material. Since this kind of thermal recording method superiors to the conventional recording method from the view point of noiseless at recording process, does not need developing and fixing processes, maintenance free, equipment is relatively cheap and compact and the obtained image is very clear, therefore, this method is widely applied in the field of facsimile or computer, various kinds of measuring instrument and for a labeling machine along with the growth of an information industry. The recording devices attached to these instruments are becoming more diversified and more high-performance, and the required quality to the thermal recording material is becoming more severe. Along with the miniaturization of an instrument and requirement for higher recording speed, it becomes necessary to obtain deep and clear color developing image.

For the purpose to meet the requirement, for example, in the Japanese Patent Laid open Publication 56-169087, a method to improve the color developing sensitivity by adding a thermo fusion substance to a thermally sensitive layer is disclosed, and in the Japanese Patent Laid Open Publication 56-144193, a method to improve the color developing sensitivity by using new color developing agent which has high color developing ability is disclosed. However, these methods can not be said to have a sufficient quality, because these methods have defects such as deterioration of ground color by heat, powder generation by aging and dropping of color density after preserved for long time (reprinting ability). Further, the method to use dye, color developing agent together with adequate sensitizer can be used. For example, in a case that the color developing agent is a phenol type compound represented by bisphenol A, p-benzylbiphenyl (Japanese Patent Laid Open Publication 60-82382), p-benzyloxybenzoicbenzyl (Japanese Patent Laid Open Publication 57-201691) or benzylnaphthyleter (Japanese Patent Laid Open Publication 58-87094) can be used as an adequate sensitizer. When a sensitizer is used, the sensitizer is fused in the first place and the fused sensitizer dissolves dye and color developing agent and are mixed by molecular size level so as to cause the color developing reaction, therefore, the selection of the kind of sensitizer, dye and color developing agent is very important.

Dihydroxydiphenylsulfone compound, which is used as an organic color developing agent is a well-known conventional compound, however, the color developing ability of it is too poor to meet the current requirement for high sensitivity. As the method to improve the color developing sensitivity, in Japanese Patent Laid Open Publication 4-69283, a method to add di(p-methylbenzyl)oxalate is disclosed and in Japanese Patent Laid Open Publication 8-67070, a method to add solid solution composed of two types of oxalic acid ester derivatives is disclosed. By said methods, the color developing sensitivity can be improved more or less, however, from the view points of heat resistance and quality of ground color, these methods can not be said as a sufficient ones. As mentioned above, by the conventional thermal sensitive recording medium, it is difficult to meet the current requirement to improve color developing sensitivity, further, is also difficult to meet the other requirements for quality such as to have good heat resistance and excellent of ground color.

DISCLOSURE OF THE INVENTION

The object of this invention is to provide a thermal recording material which has good color developing sensitivity, strong heat resistance of ground color and excellent ground.

The inventors of this invention have conduced an intensive study and have found that in a thermal recording material which possesses a thermally sensitive color developing layer containing colorless or pale colored basic colorless dye and an organic color developing agent as main components, the thermal recording material which contains at least one kind of dihydroxydiphenylsulfone type compound represented by following general formula (1) and containing at least one kind of sulfonamide compound represented by following general formula (2) can solve the above mentioned problems, and accomplished the present invention. Further, in this invention, more excellent color developing sensitivity can be obtained by containing 1,2-bis(phenoxymethyl)benzene.

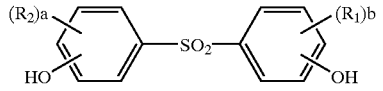

(1)

(in this formula, $R_1$ and $R_2$ is an alkyl group or an alkenyl group of carbon number 1 to 8, or a halogen atom and a and b is an integer number of 0 to 3)

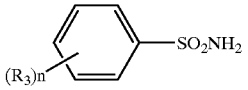

(2)

(in this formula, $R_3$ is an alkyl group of carbon number 1–6 or an electron attracting group and n is an integer of 0 to 2)

In general, it is concerned that the velocity of dissolution and diffusion or solubility of the dye into the melted color developing agent give the important effects to the color developing sensitivity of thermal recording material. To improve said effects, the method to add various kinds of material as a sensitizer is carried out. It is concerned that the addition of sensirizer causes several effects such as falling down of melting point, falling down of activated energy, change of polar, improvement of solubility of each materials, and the velocity for fusing, dissolving and dispersing and saturated solubility are improved. Thus the color developing sensitivity of the thermal recording material can be improved.

In this invention, the reason why is not made clear, but it is concerned that the color developing sensitivity can be improved without causing a remarkable falling down of melting point by containing a dihydroxydiphenylsulfone compound, further containing sulfonamide compound.

Therefore, it is concerned that although the color developing sensitivity is improved, color developing of the ground color does not occur.

In the meanwhile, 1,2-bis(phenoxymethyl)benzene is well-known as a sensitizer, and it is confirmed that when 1,2-bis(phenoxymethyl)benzene is added besides dihydroxydiphenylsulfone compound and sulfonamide compound, the color developing sensitivity can be further improved.

Further, in this invention, when at least one kind of specific compound selected from the group composed of 4-benzyloxy-4'-(2,3-epoxy-2-methylpropoxy) diphenylsulfone, epoxy resin and diphenylsulfone bridgeable type compound are contained, it is recognized that the image preservative property of color developed part is improved. The reason why is not made clear, however, it is concerned that said specific compound is bonded with an electro charge transferring complex which is formed by the reaction between dye and color developing agent and becomes more stable state.

droxydiphenylsulfone compound represented by general formula (1) is contained as an organic color developing agent. The concrete example of general formula (1) can be mentioned below. However, not intend to be limited to these compounds.

4,4'-dihydroxydiphenylsulfone (1-1)
2,4'-dihydroxydiphenylsulfone (1-2)
bis-(3-allyl-4-hydroxyphenyl)sulfone (1-3)
3,3'-dimethyl-4,4'-dihydroxydiphenylsulfone (1-4)
3,3',5,5'-tetramethyl-4,4'-hydroxyphenylsulfone (1-5)
2,2'-bis(4-chrolophenol)sulfone (1-6)
4-hydroxyphenyl-3'-isopropyl-4'-dihydroxydiphenylsulfone (1-7)
bis-(3-ethyl-4-hydroxyphenyl)sulfone (1-8)
2,2'-bis(p-t-buthylphenol)sulfone (1-9)
2,2'-bis(p-t-penthylphenol)sulfone (1-10)
2,2'-bis(p-t-octylphenol)sulfone (1-11)

In these compounds, the compounds of (1-1)–(1-3) are desirably use, because of good sensitivity, strong heat (3)

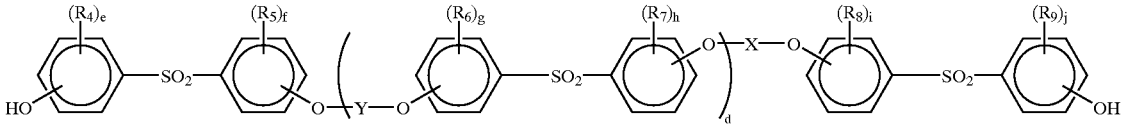

[in the formula, X and Y can be different and indicate a saturated or an unsaturated liner or a grafted hydrocarbon group of carbon number 1 to 12 which can possess an ether bond, or indicate (a)

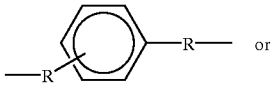

(b)

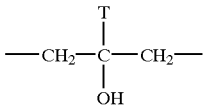

(R indicates a methylene group or an ethylene group, T indicates a hydrogen atom or an alkyl group of carbon number 1 to 4,)

and $R_4$–$R_9$ independently indicate a halogen atom, an alkyl group or an alkenyl group of carbon number 1 to 6, further, e, f, g, h, i, and j indicate an integer number of 0 to 4 and when are bigger than 2, $R_4$–$R_9$ can be different, and d is an integer of 0 to 10]

THE BEST EMBODYMENT TO CARRY OUT THE INVENTION

The thermal sensitive recording medium of this invention, for example, can be produced by following method. That is, prepare the dispersion in which a dye and compounds represented by general formula (1), general formula (2), 1,2-bis(phenoxymethyl)benzene and a stabilizer at need are dispersed with a binder, then a filler and other necessary additives are added. Thus the coating for a thermal sensitive color developing layer is prepared. The prepared coating is coated on a substrate and dried up so as to form a thermal sensitive color developing layer. In this invention, dihyresistance, and easily purchase from the market. These color developing agents can be used alone or together with.

Further, in this invention, sulfonamide compound represented by general formula (2) is contained. When the quantity of sulfonamide compound to be contained is too small to dihydroxydiphenylsulfone compound, since mutual solubility of dye, color developing agent and sesitizer is not improved, good color developing sensitivity can not be obtained, on the contrary, when the quantity of sulfonamide compound to be contained is too much, the color density is slightly deteriorated and powder generation can be observed, further adherence of depositions to a thermal head and sticking at recording are observed. In this invention, it is desirable to use 0.5–1.4 parts of sulfonamide compound to 1 part of dihydroxydiphenylsulfone compound.

In the compound represented by general formula (2), $R_3$ can be a substituted group which does not prevent the sensitizing effect, and as the example of said substituted group, an alkyl group of carbon number 1–6 or an electron attracting group such as halogen atom can be mentioned. As the concrete examples of compound represented by general formula (2), compounds indicated by (2-1)–(2-30) can be mentioned, however, not intended to be limited to these compounds. Among these compounds, (2-2) and (2-4) are desirably used, because these compounds display good effect when used together with an organic color developing agent represented by general formula (1). These compounds can be used alone or together with.

(2-1)

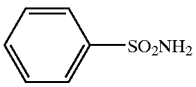

-continued
(2-2)
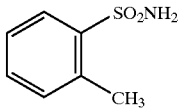
(2-3)
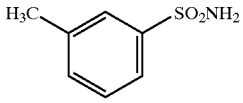
(2-4)
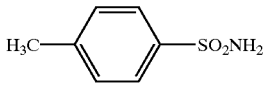
(2-5)
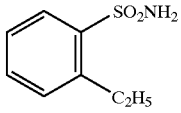
(2-6)
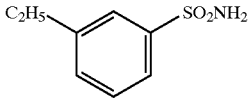
(2-7)
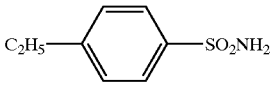
(2-8)
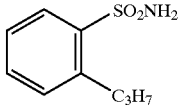
(2-9)
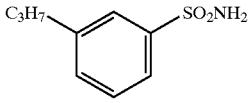
(2-10)
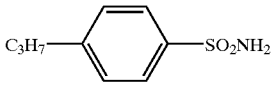
(2-11)
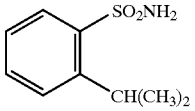
(2-12)
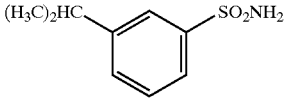
(2-13)
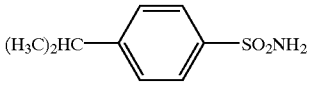
(2-14)
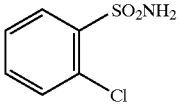
(2-15)
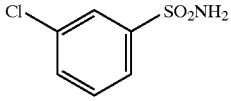
-continued
(2-16)
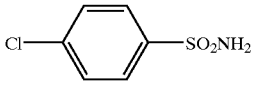
(2-17)
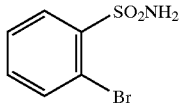
(2-18)
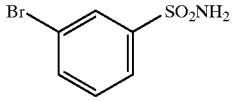
(2-19)
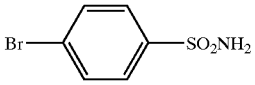
(2-20)
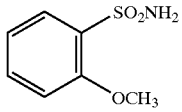
(2-21)
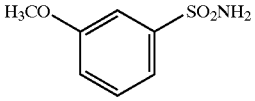
(2-22)
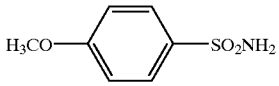
(2-23)
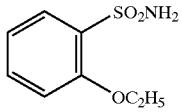
(2-24)
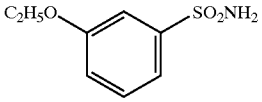
(2-25)
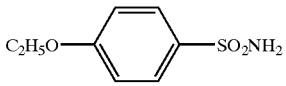
(2-26)
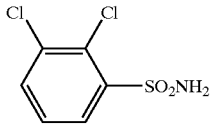
(2-27)
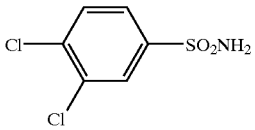
(2-28)
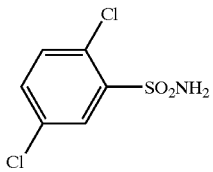

-continued (2-29)

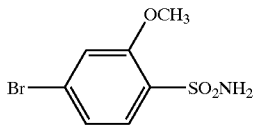

(2-30)

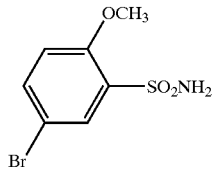

Further, in this invention, 1,2-bis(phenoxymethyl) benzene can be contained in a thermally sensitive color developing layer. When the quantity of 1,2-bis (phenoxymethyl)benzene to be contained is too small, the color developing sensitivity can not remarkably improved, and when too much, adherence of depositions to a thermal head and sticking at recording are easily caused. In this invention, it is desirable to use 0.5–1.4 parts of 1,2-bis (phenoxymethyl)benzene to 1 part of dihydroxydiphenylsulfone compound. When the ratio of sulfonamide compound and 1,2-bis(phenoxymethyl)benzene is in 1:3 to 3:1, the color developing sensitivity and the heat resistance are well balanced.

Further, in this invention, 4-benzyloxy-4'-(2,3-epoxy-2-methylpropoxy) diphenylsulfone, epoxy resin and diphenylsulfone bridgeable type compound represented by general formula (3) can be contained. If the amount of these compounds is too small to dihydroxydiphenylsulfone compound represented by general formula (1), the image stabilizing effect is not sufficient, and if too much, sensitivity and heat resistance are deteriorated. In this invention, it is desirable to use 0.01 to 0.9 parts of these compounds to 1 part of dihydroxydiphenylsulfone compound. Especially, if exceed 0.17 parts, the image preservative property to plasticizer can be improved.

As the epoxy resin, bisphenol A type epoxy resin, phenol novolak type epoxy resin, cresol novolak type epoxy resin and copolymer of glicidylmethacrylate and vinyl monomer can be mentioned. Among these compounds, the copolymer of glicidylmethacrylate and vinyl monomer can be desirably used because of good effect as a stabilizer and excellent heat resistance. Further, the copolymer of glicidylmethacrylate and vinyl monomer whose average molecular weight is 9000–11000, epoxy equivalent is 300–600 and melting point is lower than 110° C.

The diphenylsulfone bridgeable type compound represented by general formula (3) is described in Japanese Patent Laid Open Publication 10-29969.

dimethylmethylene group, methylethylene group, methyleneethylene group, ethylethylene group, 1,2-dimethylethylene group, 1-methyltrimethylene group, 1-methyltetramethylene group, 1,3-dimethyltrimethylene group, 1-ethyl-4-methyl-tetramethylene group, vinylene group, propenylene group, 2-butenylene group, ethynylene group, 2-butynylene group, 1-vinylethylene group, ethyleneoxyethylene group, tetramethyleneoxytetramethylene group, ethyleneoxyethyleneoxyethylene group, ethyleneoxymethyleneoxyethylene group, 1,3-dioxane-5,5-bismethylene group, 1,2-xylyl group, 1,3-xylyl group, 1,4-xylyl group, 2-hydroxytrimethylene group, 2-hydroxy-2-methyltrimethylene group, 2-hydroxy-2-ethyltrimethylene group, 2-hydroxy-2-propyltrimethylene group, 2-hydroxy-2-isopropyltrimethylene group and 2-hydroxy-2-butyltrimethylene group can be mentioned.

Alkyl or alkenyl group of $R_4$–$R_9$ is an alkyl group of carbon number 1 to 6 or an alkenyl group of carbon number 1 to 6, and as a concrete example, methyl group, ethyl group, n-propyl group, isopropyl group, n-butyl group, sec-butyl group, tert-butyl group, n-pentyl group, isopentyl group, neopentyl group, tert-pentyl group, n-hexyl group, isohexyl group, 1-metylpentyl group, 2-methylpentyl group, vinyl group, allyl group, isopropenyl group, 1-propenyl group, 2-butenyl group, 3-butenyl group, 1,3-butandienyl group and 2-methyl-2-propenyl group can be mentioned.

And as a halogen atom, chloride, bromine, fluorine or iodine can be mentioned.

In this invention, referring to the diphenylsulfone bridgeable type compound represented by general formula (3), several kinds of said compound whose substitution group and/or number of d are different can be used together with. And the mixing ratio is voluntary. And as the mixing method, a mixing method by powder, a mixing method in aqueous dispersion and a method to react several kinds of diphenylsulfone bridgeable type compound simultaneously by controlling reactive condition can be mentioned, however, not intend to be limited to them.

When several kinds of diphenylsulfone bridgeable type compound represented by general formula (3) are used together with, the desirable composition contains more than 2 kinds of compound represented by general formula (5) whose d values only are different. The method for preparation of these kinds of compound is not so difficult, that is, by changing reactive ratio of the starting materials, the compounds whose d values are different can be synthesized simultaneously by voluntary containing ratio.

(4)

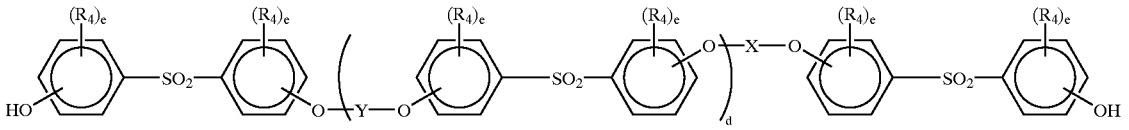

In general formula (3), the concrete examples of groups represented by X and Y are mentioned as follow. That is, methylene group, ethylene group, trimethylene group, tetramethylene group, pentamethylene group, hexamethylene group, heptamethylene group, octamethylene group, nonamethylene group, decamethylene group, undecamethylene group, dodecamethylene group, methylmethylene group,

[in the formula, X, Y, $R_4$, m and d are same to the above]

As a concrete example of compound represented by general formula (3), following compounds can be mentioned.

(3-1)

4,4'-bis[4-[4-(4-hydroxyphenylsulfonyl)phenoxy]-2-trans-butenyloxy]diphenyl sulfone (3-2)
4,4'-bis[4-(4-hydroxyphenylsulfonyl)phenoxy-4-butyloxy]diphenylsulfone
(3-3)
4,4'-bis[4-(4-hydroxyphenylsulfonyl)phenoxy-3-propyloxy]diphenylsulfone
(3-4)
4,4'-bis[4-(4-hydroxyphenylsulfonyl)phenoxy-2-ethyloxy]diphenylsulfone
(3-5)
4-[4-(4-hydroxyphenylsulfonyl)phenoxy-4-butyloxy]-4'-[4-(4-hydroxyphenylsulfonyl)phenoxy-3-propyloxy]diphenylsulfone
(3-6)
4-[4-(4-hydroxyphenylsulfonyl)phenoxy-4-butyloxy]-4'-[4-(4-hydroxyphenylsulfonyl)phenoxy-2-ethyloxy]diphenylsulfone
(3-7)
4-[4-(4-hydroxyphenylsulfonyl)phenoxy-3-propyloxy]-4'-[4-(4-hydroxyphenylsulfonyl)phenoxy-2-ethyloxy]diphenylsulfone
(3-8)
4-4'-bis[4-(4-hydroxyphenylsulfonyl)phenoxy-5-pentyloxy]diphenylsulfone
(3-9)
4,4'-bis[4-(4-hydroxyphenylsulfonyl)phenoxy-6-hexyloxy]diphenylsulfone
(3-10)
4-[4-[4-hydroxyphenylsulfonyl]phenoxy]-2-trans-butenyloxy]-4'-[4-(4-hydroxyphenylsulfonyl)phenoxy-4-butyloxy]diphenylsulfone
(3-11)
4-[4-(4-hydroxyphenylsulfonyl)phenoxy-2-trans-butenyloxy]-4'-[4-(4-hydroxyphenylsulfonyl)phenoxy-3-propyloxy]diphenylsulfone
(3-12)
4-[4-[4-(4-hydroxyphenylsulfonyl)phenoxy]-2-trans-butenyloxy]-4'-[4-(4-hydroxyphenylsulfonyl)phenoxy-2-ethyloxy]diphenylsulfone
(3-13)
1,4-bis[4-[4-[4-(4-hydroxyphenylsulfonyl)phenoxy-2-trans-butenyloxy]phenylsulfonyl]phenoxy]-cis-2-butene
(3-14)
1,4-bis[4-[4-[4-(4-hydroxyphenylsulfonyl)phenoxy-2-trans-butenyloxy]phenylsulfonyl]phenoxy]-trans-2-butene
(3-15)
4,4'-bis[4-[4-(2-hydroxyphenylsulfonyl)phenoxy]butyloxy]diphenylsulfone
(3-16)
4,4'-bis[4-[2-(4-hydroxyphenylsulfonyl)phenoxy]butyloxy]diphenylsulfone
(3-17)
4,4'-bis[4-(4-hydroxyphenylsulfonyl)phenoxy-2-ethylenoxyethoxy]diphenylsulfone
(3-18)
4,4'-bis[4-(4-hydroxyphenylsulfonyl)phenyl-14-phenylenebismethyleneoxy]diphenylsulfone,
(3-19)
4,4'-bis[4-(4-hydroxyphenylsulfonyl)phenyl-1,3-phenylenebismethyleneoxy]diphenylsulfone
(3-20)
4,4'-bis[4-(4-hydroxyphenylsulfonyl)phenyl-1,2-phenylenebismethyleneoxy]diphenylsulfone
(3-21)
2,2'-bis[4-[4-[4-(4-hydroxyphenylsulfonyl)phenoxy-2-ethyleneoxyethoxy]phenylsulfonyl]phenoxy]diethyl ether
(3-22)
α,α'-bis[4-[4-[4-(4-hydroxyphenylsulfonyl)phenyl -1,4-phenylenebismethyleneoxy]phenylsulfonyl]phenoxy]-p-xylene
(3-23)
α,α'-bis[4-[4-[4-(4-hydroxyphenylsulfonyl)phenyl-1,3-phenylenebismethyleneoxy]phenylsulfonyl]phenoxy]-m-xylene
(3-24)
α,α'-bis[4-[4-[4-(4-hydroxyphenylsulfonyl)phenyl-1,2-phenylenebismethyleneoxy]phenylsulfonyl]phenoxy]-O-xylene
(3-25)
2,4'-bis[2-(4-hydroxyphenylsulfonyl)phenoxy-2-ethyleneoxyethoxy]diphenylsulfone
(3-26)
2,4'-bis[4-(2-hydroxyphenylsulfonyl)phenoxy-2-ethyleneoxyethoxy]diphenylsulfone
(3-27)
4,4'-bis[3,5-dimethyl-4-(3,5-dimethyl-4-hydroxyphenylsulfonyl)phenoxy-2-ethyleneoxyethoxy]diphenylsulfone
(3-28)
4,4'-bis[3-allyl-4-(3-allyl-44-hydroxyphenylsulfonyl)phenoxy-2-ethyleneoxyethoxy]diphenylsulfone
(3-29)
4,4'-bis[3,5-dimethyl-4-(3,5-dimethyl-4-hydroxyphenylsulfonyl)phenyl-1,4-phenylenebismethyleneoxy]diphenylsulfone
(3-30)
4,4'-bis[3,5-dimethyl-4-(3,5-dimethyl-4-hydroxyphenylsulfonyl)phenyl-1,3-phenylenebismethyleneoxy]diphenylsulfone
(3-31)
4,4'-bis[3,5-dimethyl-4-(3,5-dimethyl-4-hydroxyphenylsulfonyl)phenyl-1,2-phenylenebismethyleneoxy]diphenylsulfone
(3-32)
4,4'-bis[3-allyl-4-(3-allyl-4-hydroxyphenylsulfonyl)1,4-phenylenebismethyleneoxy]diphenylsulfone
(3-33)
4,4'-bis[3-allyl -4-(3-allyl-4-hydroxyphenylsulfonyl)1,3-phenylenebismethyleneoxy]diphenylsulfone
(3-34)
4,4'-bis[3-allyl-4-(3-allyl-4-hydroxyphenylsulfonyl)1,2-phenylenebismethyleneoxy]diphenylsulfone
(3-35)
4,4'-bis[4-(4-hydroxyphenylsulfonyl)phenoxy-2-hydroxypropyloxy]diphenylsulfone
(3-36)
1,3-bis[4-[4-[4-(4-hydroxyphenylsulfonyl)phenoxy-2-hydroxypropyloxy]phenylsulfonyl]phenoxy]-2-hydroxypropane.

Further, among the compounds represented by general formula (4), the compound of d=0 is the compounds disclosed in Japanese Patent Application 7-149713, PCT Laid Open Publication WO93/06074 and WO95/33714. And concretely, 1,3-bis[4-(4-hydroxyphenylsulfonyl)phenoxy]-2-hydroxypropane, 1,1-bis[4-(4-hydroxyphenylsulfonyl)phenoxy]methane, 1,2-bis[4-(4-hydroxyphenylsulfonyl)phenoxy]ethane, 1,3-bis[4-(4-hydroxyphenylsulfonyl)phenoxy]propane, 1,4-bis[4-(4-hydroxyphenylsulfonyl)phenoxy]butane, 1,5-bis[4-(4-hydroxyphenylsulfonyl)phenoxy]pentane, 1,6-bis[4-(4-hydroxyphenylsulfonyl)phenoxy]hexane, α,α'-bis[4-(4-hydroxyphenylsulfonyl)phenoxy]-p-xylene, α,α'-bis[4-(4-hydroxyphenylsulfonyl)phenoxy]-m-xylene, α,α'-bis[4-(4-hydroxyphenylsulfonyl)phenoxy]-o-xylene, 2,2'-bis[4-(4-hydroxyphenylsulfonyl)phenoxy]diethyl ether, 4,4'-bis[4-(4-hydroxyphenylsulfonyl)phenoxy]dibuthyl ether, 1,2-bis[4-(4-hydroxyphenylsulfonyl)phenoxy]ethylene and 1,4-bis[4-(4-hydroxyphenylsulfonyl)phenoxy]-2-butene can be mentioned.

The compound represented by general formula (3) can be obtained by the method described in International Patent Laid Open Publication WO97/16420 which reacts 4,4'-dihydroxyphenylsulfone derivatives or 2,4'-dihydroxyphenylsulfone derivatives under the presence of basic compound. The compound used in this invention contains one or more kinds of diphenylsulfone bridgeable type compound prepared by above mentioned method, and the compounds obtained by following synthetic examples are desirably used.

Synthetic Example 1

16.0 g (0.4 mole) of sodium hydroxide is added to 21.2 g of water and dissolved, then 50.0 g (0.2 mole) of 4,4'-dihydroxydiphenylsulfone (BPS) is added. Then, 14.3 g (0.10 mole) of bis(2-chloroethyl)ether is added at 105° C., reacted for 5 hours at 110–115° C. After the reaction is over, 375 ml of water is added to the reacted solution, stirred for 1 hour at 90° C. Then cooled down to the room temperature, neutralized by 20% sulfuric acid. The crystallized solid is filtrated, and 39.3 g of white crystalline is obtained. The yield to bis(2-chloroethyl)ether is 88%. The obtained component is analyzed by high performance liquid chromatography and identified as follows. As the column, Mightysil RP-18 (product of Kanto Chemical Co., Ltd.) is used, and moving bed is $CH_3CN:H_2O:1\%H_3PO_4$=700:300:5, and UV wave length is 260 nm.

| | | |
|---|---|---|
| d = 0:retention time | 1.9 minutes:area % | 32.9 |
| d = 1:retention time | 2.3 minutes:area % | 21.7 |
| d = 2:retention time | 2.7 minutes:area % | 12.8 |
| d = 3:retention time | 3.4 minutes:area % | 8.8 |
| d = 4:retention time | 4.2 minutes:area % | 5.8 |
| d = 5:retention time | 5.4 minutes:area % | 3.5 |
| d = 6:retention time | 7.0 minutes:area % | 2.2 |
| d = 7:retention time | 9.0 minutes:area % | 1.7 |
| d = 8:retention time | 11.8 minutes:area % | 1.3 |
| d = 9:retention time | 15.4 minutes:area % | 1.3 |

Synthetic Example 2–4

The molar ratio of BPS and bis(2-chloroethyl)ether of Synthetic 1 is changed to 1.5:1, 2.5:1, 3.0:1, and following composition can be obtained.

In a case of 1.5:1, d=0 is 20.8, d=1 is 33.0, d=2 is 14.2, d=3 is 7.9, d=4 is 3.9

In a case of 2.5:1, d=0 is 49.6, d=1 is 25.9, d=2 is 11.4, d=3 is 5.3, d=4 is 2.4

In a case of 3.0:1, d=0 is 56.9, d=1 is 24.9, d=2 is 9.6, d=3 is 3.7, d=4 is 1.3

Synthetic Example 5

In a mixed solution of 10.0 g of 48% of aqueous solution of sodium hydroxide and 155 g of N,N'-dimethylacetoamide, 30.0 g (0.12 mole) of BPS is added. After temperature is risen to 80° C. and BPS is dissolved, 10.5 g (0.06 mole) of α,α'-dichloro-p-xylene dissolved in 15 g of xylene is dropped slowly. Then, ripened 2 hours by same temperature. After ripened, the solution is poured into 900 ml of water and the crystallized solid is filtrated. The obtained crude crystalline is rinsed by methanol, filtrated and dried up, and 19.7 g of white crystalline is obtained. Analyzed by high performance liquid chromatography, and the main components are identified as follows.

α,α'-bis[4-(4-hydroxyphenylsulfonyl)phenoxy]-p-xylene 59.1%

4,4'-bis[4-(4-hydroxyphenylsulfonyl)pheny-1,4-phenylenebismethyleneoxy]diphenylsulfone 23.1%.

α,α'-bis[4-[4-[4-(4-hydroxyphenylsulfonyl)phenyl-1,4-phenylenebismethyleneoxy]phenylsulfonyl]phenoxy]-p-xylene 11.1%

As the leuco color developing type basic colorless dye used in this invention, all well known dye in the field of conventional pressure sensitive type or thermally sensitive type recording paper can be used, and triphenyl methane type compound, fluoran type compound, fluorene type compound or divinyl type compound are desirably used, however, not intends to be limited to them. Typical example of colorless or pale colored leuco dye (dye precursor) are mentioned below. Further, these dye precursor can be used alone or together with.

<Triphenylmethane Type Leuco Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran Type Leuco Dyes>

3-diethylamino-6-methylfluoran 3-diethylamino-6-methyl-7-anilinofluoran 3-diethylamino-6-methyl-7-(o,p-dimethylanilino)fluoran 3-diethylamino-6-methyl-7-chlorofluoran 3-diethylamino-6-methyl-7-(m-trifluoromethylanilino)fluoran 3-diethylamino-6-methyl-7-(o-chloroanilino)fluoran 3-diethylamino-6-methyl-7-(p-chloroanilino)fluoran 3-diethylamino-6-methyl-7-(o-fluoroanilino)fluoran 3-diethylamino-6-methyl-7-(m-methylanilino)fluoran 3-diethylamino-6-methyl-7-n-octylanilinofluoran 3-diethylamino-6-methyl-7-n-octylaminofluoran 3-diethylamino-6-methyl-7-benzylanilinofluoran 3-diethylamino-6-methyl-7-dibenzylanilinofluoran 3-diethylamino-6-chloro-7-methylfluoran 3-diethylamino-6-chloro-7-anilinofluoran 3-diethylamino-6-chloro-7-p-methylanilinofluoran
3-diethylamino-6-ethoxyethyl-7-anilinofluoran
3-diethylamino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylaniino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino) fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-7-(m-trifluoromethylaniliono)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino) fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl) aminoanilinofluoran
2-methoxy-6-p-(p-dimethylaminophenyl) aminoanilinofluoran
2-chloro-3-methyl-6-p-(p-phenylaminophenyl) aminoanilinofluoran
2-chloro-6-p-(p-dimethylaminophenyl) aminoanilinofluoran
2-nitro-6-p-(p-diethylaminophenyl)aminoanilinofluoran
2-amino-6-p-(p-diethylaminophenyl)aminoanilinofluoran
2-diethylamino-6-p-(p-diethylaminophenyl) aminoanilinofluoran
2-phenyl-6-metyl-6-p-(p-phenylaminophenyl) aminoanilinofluoran
2-benzyl-6-p-(p-phenylaminophenyl) aminoanilinofluoran
2-hydroxy-6-p-(p-phenylaminophenyl) aminoanilinofluoran
3-methyl-6-p-(p-dimethylaminophenyl) aminoanilinofluoran
3-diethylamino-6-p-(p-diethylaminophenyl) aminoanilinofluoran
3-diethylamino-6-p-(p-dibutylaminophenyl) aminoanilinofluoran
2,4-dimethyl-6-[(4-dimethylamino)anilino]-fluoran <Fluorene Type Leuco Dyes>

3,6,6'-tris(dimethylamino)spiro[fluorene-9,3'-phthalide]
3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl)ethenyl]-4,5,6,7-tetrabromophthalide
3,3-bis-[2-(p-dimethylaminophenyl)-2-(p-methoxyphenyl)ethenyl]-4,5,6,7-tetrachlorophthalide
3,3-bis-[1,1-bis(4-pyrrolidinophenyl)ethylen-2-yl]-4,5,6,7-tetrabromophthalide
3,3-bis-[1-(4-methoxyphenyl)-1-(4-pyrrolidinophenyl) ethylene-2-yl]-4,5,6,7-tetrachlorophthalide <Others>

3-(4-diethyl amino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluoran-γ-(3'-nitro)anilinolactam
3,6-bis(diethylamino)fluoran-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoylethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonicacid dimethylester.

Among these compounds, especially, 3-di-n-pentylamino-6-methyl-7-anilinofluoran is desirably used because whiteness of ground color and heat resistance are good.

In this invention, it is concerned that the whiteness of ground color is good, because by combing specific compound as dye, the coloring of coating can be avoided. In general, it is concerned that the coloring of the coating is caused as follows. Namely, a part of materials contained in coating is dissolved in water, and it reacts with dye. For example, 4-4'-dihydroxy diphenylsulfone contains two —OH groups by which basic colorless dye is color developed, and is easily dissolved in water. The inventors of this invention have conduced intensive study, and have clarified that the coloring of the coating can be peculiarly prevented by combining 3-di-n-pentylamino-6-methyl-7-anilinofluoran as a dye. The reason why is still unclear, however, since the degree of solubility to water of 3-di-n-pentylamino-6-methyl-7-anilinofluoran is lower than $1.349\times 10^{-6}$ g/l, which is recognized as very low level, and the coloring of coating is very low, therefore the whiteness of ground color is maintained to high level.

In the present invention, the well known conventional sensitized can be used in the limitation not to prevent the desirable effect to said object. As the concrete example, fatty acid amide such as stearic acid amide and palmitic acid amide,
ethylenebisamide,
montan acid wax,
polyethylene wax,
diphenylsulfone,
1,2-di-(3-methylphenoxy)ethane,
p-benzilbiphenyl,
β-benzyloxynaphthalene,
4-biphenyl-p-tolylether,
m-tarphenyl,
1,2-diphenoxyethane,
dibenzyl4,4'-ethylenedioxy-bis-benzoate,
dibenzoyloxymethane,
1,2-di(3-methylphenoxy)ethylene,
1,2-diphenoxyethylene,
bis[2-(4-methoxy-phenoxy)]ethyl]ether,
p-nitromethylbenzoate,
dibenzyloxalate,
di(p-chlorobenzyl)oxalate,
di(p-methylbenzyl)oxalate,
dibenzylterephthalate,
benzyl p-benzyloxybenzoate,
di-p-tolylcarbonate,
phenyl-α-naphthylcarbonate,
1,4-diethoxynaphthalene,
phenyl 1-hydroxy-2-naphthoate and
4-(m-methylphenoxymethyl)biphenyl, can be mentioned, however, not intends to be restricted to them. These sensitizer can be used alone or can be used together with.

As the binder to be used in the present invention, full saponificated polyvinyl alcohol of 200–1900 polymerization degree, partial saponificated polyvinyl alcohol, denatured polyvinyl alcohol by carboxyl, denatured polyvinyl alcohol by amide denatured polyvinyl alcohol by sulfonic acid denatured polyvinyl alcohol by butylal modified polyvinyl alcohol, derivatives of cellulose such as hydroxyethyl cellulose, methyl cellulose, ethyl cellulose, carboxymethyl cellulose and acetyl cellulose, copolymer of styrene-maleic unhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be illustrated. These macromolecule compounds can be applied by being dissolved into solvents such as water, alcohol, ketone, ester or hydrocarbon or by being dispersed in water or other medium under an emulsion state or a paste state and these forms of application can be used in combination according to the quality requirement.

And in this invention, as the image stabilizer showing oil resistance effect of recorded image, 4,4'-buthylidene(6-t-buthyl-3-methylphenol),
2,2'-di-t-buthyl-5,5'-dimethyl-4,4'-sulphonyldiphenol,
1,1,3-tris(2-methyl-4-hydroxy-5-cyclohexylphenyl) buthane and
1,1,3-tris(2-methyl-4-hydroxy-5-t-buthylphenyl)buthane can be added in the limit not to prevent above mentioned desired effect.

As a filler which can be used in this invention, an inorganic or an organic filler such as silica, calcium carbonate, kaoline, calcined kaoline, diatomaceous earth, talc, titanium oxide or aluminum hydroxide can be mentioned. Further, a slipping agent such as waxes, an ultra violet ray absorbing agent such as benzophenone type or triasol type compound, a water proof agent such as glioxasal, a dispersing agent, a defoamer, an anti oxidation agent and fluoresene dye can be used.

The amount of color developer and dye precursor, the kind and amount of other additives to be used to the thermal recording material of this invention are decided according to the required quality and recording feature, and not restricted. However, in general, it is preferable to use 0.1–2 parts of basic colorless dye, 0.01–2 parts and 0.5–4 parts of filler to 1 part of color developing agent indicated by general formula (1) are used. And the desirable amount of binder is 5–25% to the total amount of solid.

The coating of above mentioned component is coated over the surface of substrate such as paper, recycled paper, synthetic paper, film, plastic film, plastic foam film, non-woven cloth or gold foil, and the desired thermal recording material can be obtained. The complex sheet composed of above mentioned materials can also be used.

Further, to improve the preservative property, an overcoat layer can be prepared on the thermally sensitive color developing layer. Said organic color developer, basic colorless dye and other additives which are added at need are ground to the fine particles smaller than several microns diameter by means of a pulverizer such as a ball mill, an attriter or a sand grinder, or by means of an adequate emulsifying apparatus, then binder and other additives are added at need, thus the coating is prepared. The method to coat is not restricted, and can be coated by conventional well known methods, for example, an off machine coating machine with various coater such as air knife coater, rod blade coater, bill blade coater or roll coater, or an on machine coating machine can preferably used.

EXAMPLE

The thermal recording material of this invention will be illustrated more concretely by Examples, however, not intended to be limited to them. In the Examples and Comparative Examples, a term of "parts" indicates weight part.

Example 1

According to the following recipe, dispersions of dye, color developing agent and sensitizer are separately ground in wet condition to average particle diameter of 1 μm by a sand grinder.

<Dispersion of Color Developing Agent>

4,4'-dihydroxydiphenylsulfone (1-1) 6.0 parts
10% aqueous solution of polyvinyl alcohol 18.8 parts
water 11.2 parts <Dispersion of Dye>

3-di-n-buthylamino-6-methyl-7-anilinofluoran (ODB2) 2.0 parts

10% aqueous solution of polyvinyl alcohol 4.6 parts water 2.6 parts

<Dispersion of Sulfonamide(SA) Compound)

(2-4) compound 6.0 parts

10% aqueous solution of polyvinyl alcohol 18.8 parts water 11.2 parts

The compounds mentioned below are mixed and the coating for thermally sensitive layer is prepared. The obtained coating is coated over the surface of 50 g/$^2$ high grade paper and dried up so as to the coating amount is 6.0 g/m$^2$, and the obtained sheet is treated by a super calendar so as the Beck's smoothness become 200–600 sec. and the thermal recording material is obtained.

dispersion of color developing agent 36.0 parts dispersion of dye 9.2 parts dispersion of sulfonamide compound 36.0 parts 50% dispersion of kaolin clay 12.0 parts Example 2

By same process to Example 1 except changing the blending ratio of ODB2 in the dispersion of dye to 3-di-n-pentylamino-6-methyl-7-anilinofluoran (commercial name: Black305, product of Yamada Chemical Industries; hereinafter shortened to B305), the thermal recording material is obtained.

Example 3

By same process to Example 1 except using (2-2) instead of (2-4) at the preparation of the dispersion of sulfonamide compound, the thermal recording material is obtained.

Example 4

By same process to Example 1 except changing the blending ratio of the dispersion of sulfonamide compound as below, the thermal recording material is obtained.

dispersion of color developing agent 36.0 parts dispersion of dye 9.2 parts dispersion of sulfonamide compound 18.0 parts 50% dispersion of kaolin clay 12.0 parts Example 5

By same process to Example 1 except changing the blending ratio of sulfonamide dispersion as mentioned below, the thermal recording material is obtained.

dispersion of color developing agent 36.0 parts dispersion of dye 9.2 parts dispersion of sulfonamide compound 48.0 parts 50% dispersion of kaolin clay 12.0 parts Example 6

According to the following recipe, dispersions of following materials are prepared and are ground in wet condition to average particle diameter of 1 $\mu$m by a sand grinder.

<Dispersion of Stabilizer>

4-benzyloxy-4'-(2,3-epoxy-2-methylpropoxy) diphenylsulfone (commercial name: NTZ-95, product of Nihon Soda; hereinafter shortened to NTZ) 1.0 parts 10% aqueous solution of polyvinyl alcohol 3.1 parts water 1.9 parts By same process to Example 2 except adding dispersion of stabilizer, the thermal recording material of following recipe is obtained.

dispersion of color developing agent 36.0 parts dispersion of dye 9.2 parts dispersion of sulfonamide compound 36.0 parts dispersion of stabilizer 6.0 parts 50% dispersion of kaolin clay 12.0 parts Example 7

By same process to Example 6 except changing the blending ratio of stabilizer dispersion as mentioned below, the thermal recording material is obtained.

dispersion of color developing agent 36.0 parts dispersion of dye 9.2 parts dispersion of sulfonamide compound 36.0 parts dispersion of stabilizer 18.0 parts 50% dispersion of kaolin clay 12.0 parts Example 8

By same process to Example 6 except changing the blending ratio of stabilizer dispersion as mentioned below, the thermal recording material is obtained.

dispersion of color developing agent 36.0 parts dispersion of dye 9.2 parts dispersion of sulfonamide compound 36.0 parts dispersion of stabilizer 0.6 parts 50% dispersion of kaolin clay 12.0 parts Example 9, 10

By same process to Example 6 except changing 4-benzyloxy-4'-(2,3-epoxy-2-methylpropoxy) diphenylsulfone in stabilizer dispersion to copolymer of glycidilmethacrylate and vinyl polymer (average molecular weight is 1100, epoxy equivalent is 312, melting point is lower than 110° C.) (commercial name: NER-064, product of Nagase Kasei, hereinafter shortened to NER) (Example 9), or to diphenylsulfone type bridgeable compound of Synthetic Example 1 (Example 10), the thermally sensitive recording media are obtained.

Example 11

According to the following recipe, dispersions of following materials are prepared and are ground in wet condition to average particle diameter of 1 $\mu$m by a sand grinder.

<Dispersion of 1,2-bis(Phenoxymethyl)benzene (BFMB)>

1,2-bis(phenoxymethyl)benzene 6.0 parts

10% aqueous solution of polyvinyl alcohol 18.8 parts water 11.2 parts

By same process to Example 1 except adding dispersion of 1,2-bis(phenoxymethyl)benzene and changing the blending ratio as mentioned below, the thermal recording material of following recipe is obtained.

dispersion of color developing agent 36.0 parts dispersion of dye 9.2 parts dispersion of sulfonamide compound 36.0 parts dispersion of 1,2-bis(phenoxymethyl)benzene 36.0 parts 50% dispersion of kaolin clay 12.0 parts Example 12, 13

By same process to Example 11 except changing ODB2 in dye dispersion to B305 (Example 12) or to 3-(N-ethyl-N-isoamylamino)-6-methyl-7-anilinofluoran (S205) (Example 13), the thermally sensitive recording media are obtained.

Example 14

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 18.0 parts dispersion of 1,2-bis(phenoxymethyl)benzene 18.0 parts 50% dispersion of kaolin clay 12.0 parts Example 15

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 48.0 parts dispersion of 1,2-bis(phenoxymethyl)benzene 48.0 parts 50% dispersion of kaolin clay 12.0 parts Example 16

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 18.0 parts dispersion of 1,2-bis(phenoxymethyl)benzene 48.0 parts 50% dispersion of kaolin clay 12.0 parts Example 17

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 48.0 parts dispersion of 1,2-bis(phenoxymethyl)benzene 18.0 parts 50% dispersion of kaolin clay 12.0 parts Example 18

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 36.0 parts dispersion of 1,2-bis(phenoxymethyl)benzene 9.0 parts 50% dispersion of kaolin clay 12.0 parts Example 19

By same process to Example 11 except changing the blending ratio of sulfonamide compound dispersion and 1,2-bis(phenoxymethyl)benzene dispersion as mentioned below, the thermal recording material is obtained.

dispersion of color developing agent 36.0 parts dispersion of dye 9.2 parts dispersion of sulfonamide compound 36.0 parts dispersion of 1,2-bis(phenoxymethyl)benzene 60.0 parts 50% dispersion of kaolin clay 12.0 parts Example 20

By same process to Example 11 except using 2,4'-dihydroxydiphenyl sulfone (1-2) instead of (1-1) compound at the preparation of dispersion of color developing agent, the thermal recording material is obtained.

Example 21

By same process to Example 12 except using stabilizer dispersion used in Example 6 and change the blending ratio as mentioned below, the thermal recording material is obtained.

dispersion of color developing agent 36.0 parts dispersion of dye 9.2 parts dispersion of sulfonamide compound 36.0 parts dispersion of 1,2-bis(phenoxymethyl)benzene 36.0 parts dispersion of stabilizer 6.0 parts 50% dispersion of kaolin clay 12.0 parts Comparative Example 1

By same process to Example 1 except changing (1-1) compound of color developing agent dispersion to 4,4'-isopropyridendiphenol (BPA), the thermal recording material is obtained.

Comparative Example 2

By same process to Example 11 except changing (1-1) compound of color developing agent dispersion to BPA, the thermal recording material is obtained.

Comparative Example 3

By same process to Comparative Example 2 except changing ODB2 of dye dispersion to B305, the thermal recording material is obtained.

Comparative Example 4

By same process to Example 11 except not blending sulfonamide dispersion, and using the blending ratio as mentioned below, the thermal recording material is obtained.

dispersion of color developing agent 36.0 parts dispersion of dye 9.2 parts dispersion of 1,2-bis(phenoxymethyl)benzene 36.0 parts 50% dispersion of kaolin clay 12.0 parts Comparative Example 5

By same process to Example 1 except blending the dispersion mentioned below instead of sulfonamide dispersion, the thermal recording material is obtained.

<Dispersion of p-Benzylbiphenyl> p-benzylbiphenyl 6.0 parts

10% aqueous solution of polyvinyl alcohol 18.8 parts water 11.2 parts

Comparative Example 6

By same process to Example 1 except not blending sulfonamide dispersion, and using the blending ratio as mentioned below, the thermal recording material is obtained.

dispersion of color developing agent 36.0 parts dispersion of dye 9.2 parts

50% dispersion of kaolin clay 12.0 parts

Comparative Example 7

By same process to Comparative Example 1 except adding stabilizer dispersion used in Example 6, the thermal recording material is obtained.

[Color Developing Sensitivity]

Thermal recording is carried out on the prepared thermally sensitive recording media using TH-PMD, which is a product of Ohkura Denki Co., by 0.25 mJ/dot and 0.34 mJ/dot impressive energy. Image density of printing part is measured by means of a Macbeth densitometer (umber filter used)

[Degree of Whiteness of Ground Color]

Degree of whiteness of not color developed portion of specimen is meadured by Hunter Whiteness tester (product of Toyo Seiki Seisakusho, blue filter). Bigger value indicates good result.

[Heat Resistance Test]

The specimen not color developed is left in the atmosphere of 60° C. for 24 hrs and 70° C. for 1 hr, and the whiteness of each specimen are measured by a Hunter Whiteness tester (product of Toyo Seiki Seisakusho, blue filter).

[Plasticizer Resistance Test]

A single sheet of polyvinylchloride wrap (HIGHWRAP KMA: Mitsui Toatsu Chemicals Co., Ltd.) was wound round with 1 ply on a paper tube, stuck thereon a thermal recording medium recorded by TH-PMD, which is a product of Ohkura Denki Co., by 0.34 mJ/dot impressive energy, further wound round with 3 plies of the polyvinylchloride wrap, allowed to stand at 20° C. for 24 hours, and the whiteness of specimen is measured by a Macbeth densitometer.

[Heat Resistance]

The specimen color developed by 0.34 mJ/dot impressive energy using TH-PMD, which is a product of Ohkura Denki Co., is left in the atmosphere of 60° C. for 24 hours, and the specimen is measured by a Macbeth densitometer.

[Resistance to Wet Heat]

The specimen color developed by 0.34 mJ/dot impressive energy using TH-PMD, which is a product of Ohkura Denki Co., is left in the atmosphere of 60° C. and 90% humidity for 24 hours, and the specimen is measured by a Macbeth densitometer.

The test results are summarized in Tables 1–4. In Tables 1 and 2,

SA: indicates sulfonamide,

BFMB: indicates 1,2-bis(phenoxymethyl)benzene,

SA: BFMB indicates blending ratio,

Numerical number in parenthesis indicates blending parts to 1 part of color developing agent.

TABLE 1

| Example | color developing agent | SA | BFMB | dye | stabilizer | SA:BFMB |
|---|---|---|---|---|---|---|
| 1 | 1-1 | 2-4 (1) | | 0DB2 | | |
| 2 | 1-1 | 2-4 (1) | | B305 | | |
| 3 | 1-1 | 2-2 (1) | | 0DB2 | | |
| 4 | 1-1 | 2-4 (0.5) | | 0DB2 | | |
| 5 | 1-1 | 2-4 (1.33) | | 0DB2 | | |
| 6 | 1-1 | 2-4 (1) | | B305 | NTZ (0.17) | |
| 7 | 1-2 | 2-4 (1) | | B305 | NTZ (0.5) | |
| 8 | 1-1 | 2-4 (1) | | B305 | NTZ (0.017) | |
| 9 | 1-1 | 2-4 (1) | | B305 | NER (0.17) | |
| 10 | 1-1 | 2-4 (1) | | B305 | Synthetic Ex. 1 (0.17) | |
| 11 | 1-1 | 2-4 (1) | (1) | 0DB2 | | 1:1 |
| 12 | 1-1 | 2-4 (1) | (1) | B305 | | 1:1 |
| 13 | 1-1 | 2-4 (1) | (1) | S205 | | 1:1 |
| 14 | 1-1 | 2-4 (0.5) | (0.5) | 0DB2 | | 1:1 |
| 15 | 1-1 | 2-4 (1.33) | (1.33) | 0DB2 | | 1:1 |
| 16 | 1-1 | 2-4 (0.5) | (1.33) | 0DB2 | | 1:2.7 |
| 17 | 1-1 | 2-4 (1.33) | (0.5) | 0DB2 | | 2.7:1 |
| 18 | 1-1 | 2-4 (1) | (0.25) | 0DB2 | | 4:1 |
| 19 | 1-1 | 2-4 (1) | (1.67) | 0DB2 | | 1:1.7 |
| 20 | 1-2 | 2-4 (1) | (1) | 0DB2 | | 1:1 |
| 21 | 1-1 | 2-4 (1) | (1) | B305 | NTZ (0.17) | 1:1 |

TABLE 2

| Comp. Example | Color developing agent | SA | BFMB | dye | Stabilizer | SA:BFMB |
|---|---|---|---|---|---|---|
| 1 | BPA | 2-4 (1) | | 0DB2 | | |
| 2 | BPA | 2-4 (1) | (1) | 0DB2 | | 1:1 |
| 3 | BPA | 2-4 (1) | (1) | B305 | | 1:1 |
| 4 | 1-1 | | (1) | 0DB2 | | |
| 5 | 1-1 | p-benzyl biphenyl (1) | | 0DB2 | | |
| 6 | 1-1 | | | 0DB2 | | |
| 7 | BPA | 2-4 (1) | | 0DB2 | NTZ (0.17) | |

TABLE 3

| Example | sensitivity 0.25 mJ/dot | sensitivity 0.34 mJ/dot | degree of whiteness | ground color heat resistance 60° C. 24 hrs | ground color heat resistance 70° C. 1 hr | resistance of color developed part to plasticizer | resistance of color developed part to heat | resistance of color developed part to wet heat |
|---|---|---|---|---|---|---|---|---|
| 1 | 0.78 | 1.30 | 80% | 76% | 74% | 0.07 | 0.56 | 0.25 |
| 2 | 0.78 | 1.30 | 82% | 82% | 78% | 0.07 | 0.56 | 0.25 |
| 3 | 0.76 | 1.29 | 80% | 76% | 75% | 0.07 | 0.56 | 0.25 |
| 4 | 0.75 | 1.28 | 80% | 76% | 74% | 0.07 | 0.56 | 0.25 |
| 5 | 0.80 | 1.30 | 80% | 76% | 74% | 0.07 | 0.56 | 0.25 |
| 6 | 0.73 | 1.27 | 82% | 80% | 77% | 0.25 | 1.15 | 0.78 |
| 7 | 0.67 | 1.25 | 82% | 79% | 76% | 0.66 | 1.25 | 1.15 |
| 8 | 0.77 | 1.29 | 82% | 81% | 77% | 0.09 | 0.83 | 0.43 |
| 9 | 0.73 | 1.29 | 82% | 80% | 77% | 0.17 | 1.15 | 0.78 |
| 10 | 0.73 | 1.28 | 82% | 81% | 78% | 0.54 | 1.05 | 0.59 |
| 11 | 0.90 | 1.32 | 80% | 76% | 74% | 0.07 | 0.56 | 0.25 |
| 12 | 0.90 | 1.32 | 82% | 82% | 77% | 0.07 | 0.58 | 0.25 |
| 13 | 1.00 | 1.34 | 76% | 73% | 68% | 0.07 | 0.58 | 0.29 |
| 14 | 0.85 | 1.25 | 80% | 76% | 74% | 0.07 | 0.55 | 0.25 |
| 15 | 0.93 | 1.34 | 80% | 76% | 73% | 0.07 | 0.58 | 0.25 |
| 16 | 0.91 | 1.32 | 80% | 76% | 74% | 0.07 | 0.56 | 0.25 |
| 17 | 0.88 | 1.31 | 80% | 76% | 74% | 0.07 | 0.56 | 0.25 |
| 18 | 0.80 | 1.30 | 82% | 76% | 74% | 0.07 | 0.56 | 0.25 |
| 19 | 0.88 | 1.31 | 82% | 76% | 74% | 0.07 | 0.56 | 0.25 |
| 20 | 0.72 | 1.17 | 80% | 76% | 75% | 0.07 | 0.58 | 0.25 |
| 21 | 0.85 | 1.29 | 82% | 80% | 76% | 0.34 | 1.17 | 0.88 |

TABLE 4

| Comp. Example | sensitivity 0.25 mJ/dot | sensitivity 0.34 mJ/dot | degree of whiteness | ground color heat resistance 60° C. 24 hrs | ground color heat resistance 70° C. 1 hr | resistance of color developed part to plasticizer | resistance of color developed part to heat | resistance of color developed part to wet heat |
|---|---|---|---|---|---|---|---|---|
| 1 | 0.75 | 1.28 | 75% | 68% | 67% | 0.07 | 0.56 | 0.25 |
| 2 | 0.91 | 1.31 | 69% | 60% | 55% | 0.07 | 0.56 | 0.25 |
| 3 | 0.91 | 1.31 | 71% | 65% | 60% | 0.07 | 0.56 | 0.25 |
| 4 | 0.31 | 0.82 | 80% | 76% | 75% | 0.06 | 0.35 | 0.16 |
| 5 | 0.92 | 1.30 | 79% | 79% | 70% | 0.07 | 0.56 | 0.25 |
| 6 | 0.11 | 0.55 | 82% | 82% | 82% | 0.06 | 0.23 | 0.11 |
| 7 | 0.70 | 1.25 | 73% | 66% | 68% | 0.25 | 1.14 | 0.77 |

As clearly understand from above mentioned results of Tables 3 and 4, Example 1 to 21 of this invention containing sulfonamide and 1,2-bis(phenoxymethyl)benzene in thermally sensitive layer are excel in qualities such as color developing sensitivity, degree of whiteness of ground color and heat resistance. Especially, Examples 11 to 17, 20 and 21, which contain 0.5–1.4 parts of sulfonamide compound and 0.5–1.4 parts of 1,2-bis(phenoxymethyl)benzen to 1 part of color developing agent are excel in color developing sensitivity. Further, Examples 2, 6–10, 12 and 21 which use B305 as a dye are excel in degree of whiteness of ground color and heat resistance compared with the products which use other kind of dye. Furthermore, Examples 6–10 and 21 in which stabilizer is blended are excel in image preventing ability. On the contrary, Comparative Examples 1–7 has problems in all qualities.

Ability to be Used in an Industrial Scale

Since the thermal recording material of this invention is excel in color density, ground color, heat resistance, can be used as a facsimile paper, printing paper, register paper and thermally sensitive paper, and can provide a high quality and reliable thermal recording material.

What is claimed is:

1. A thermal recording material which possesses a thermally sensitive color developing layer containing colorless or pale colored basic colorless dye and an organic color developing agent as main components on a substrate, wherein said thermally sensitive recording layer contains at least one kind of dihydroxydiphenylsulfone type compound represented by general formula (1) as an organic color developing agent, further contains at least one kind of sulfonamide compound represented by general formula (2), (1)

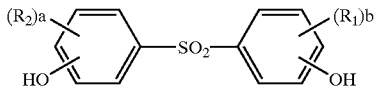

wherein, $R_1$ and $R_2$ indicate an alkyl group or an alkenyl group of carbon number 1 to 8, or a halogen atom and a and b is an integer number of 0 to 3, (2)

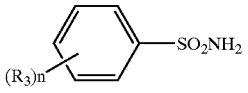

wherein, $R_3$ indicates an alkyl group of carbon number 1 to 6 or an electron attracting group and n indicates an integer of 0 to 2.

2. The thermal recording material of claim 1, wherein the thermally sensitive color developing layer further contains 1,2-bis(phenoxymethyl)benzene.

3. The thermal recording material of claim 2, wherein 3-di-n-pentylamino-6-methyl-7-anilinofluoran is contained as a basic colorless dye.

4. The thermal recording material of claim 2 further containing at least one compound selected from the group composed of 4-benzyloxy-4'-(2,3-epoxy-2-methylpropoxy) dephenylsulfone, epoxy resin and diphenyl sulfone bridgeable type compound represented by general formula (3),

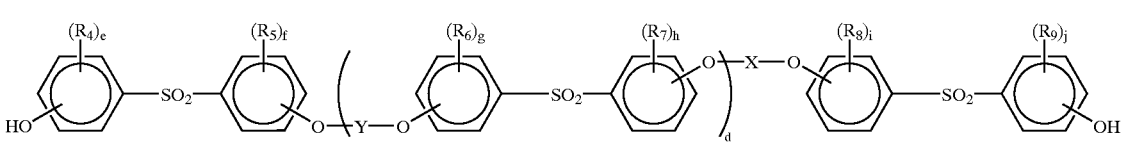

(3)

wherein, X and Y can be different and indicate a saturated or an unsaturated liner or grafted hydrocarbon group of carbon number 1 to 12 which can possess an ether bond, or indicate

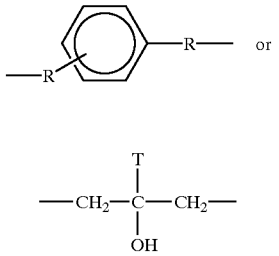

(a)

(b)

wherein, R indicates a methylene group or an ethylene group, T indicates a hydrogen atom or an alkyl group of carbon number 1 to 4, and $R_4$–$R_9$ independently indicate a halogen atom, an alkyl group of carbon number 1 to 6, or an alkenyl group, further, e, f, g, h, i, j indicate an integer number of 0 to 4 and when are bigger than 2, $R_4$–$R_9$ can be different, and d is an integer of 0 to 10.

5. The thermal recording material of claim 2, wherein 3-di-n-pentylamino-6-methyl-7-anilinofluoran is contained as a basic colorless dye and 4,4'-dihydroxydiphenylsulfone is contained as a dihydroxydiphenylsulfone component.

6. The thermal recording material of claim 1 wherein 3-di-n-pentylamino-6-methyl-7-anilinofluoran is contained as a basic colorless dye.

7. The thermal recording material of claim 6 further containing at least one compound selected from the group composed of 4-benzyloxy-4'-(2,3-epoxy-2-methylpropoxy) dephenylsulfone, epoxy resin and diphenyl sulfone bridgeable type compound represented by general formula (3),

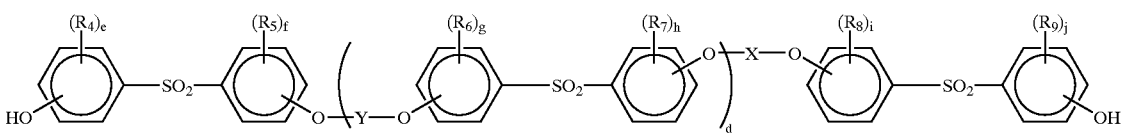

(3)

wherein, X and Y can be different and indicate a saturated or an unsaturated liner or grafted hydrocarbon group of carbon number 1 to 12 which can possess an ether bond, or indicate

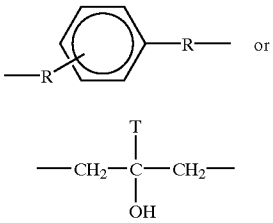

(a)

(b)

wherein, R indicates a methylene group or an ethylene group, T indicates a hydrogen atom or an alkyl group of carbon number 1 to 4, and $R_4$–$R_9$ independently indicate a halogen atom, an alkyl group of carbon number 1 to 6, or an alkenyl group, further, e, f, g, h, i, j indicate an integer number of 0 to 4 and when are bigger than 2, $R_4$–$R_9$ can be different, and d is an integer of 0 to 10.

8. The thermal recording material of claim 1 further containing at least one compound selected from the group composed of 4-benzyloxy-4'-(2,3-epoxy-2-methylpropoxy) dephenylsulfone, epoxy resin and diphenyl sulfone bridgeable type compound represented by general formula (3),

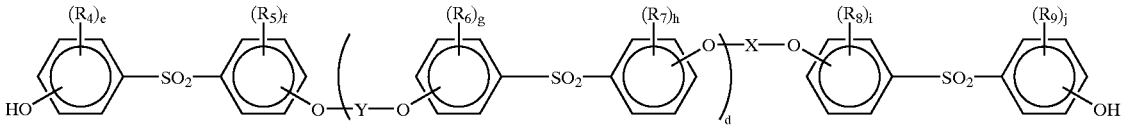

wherein, X and Y can be different and indicate a saturated or an unsaturated liner or grafted hydrocarbon group of carbon number 1 to 12 which can possess an ether bond, or indicate (a)

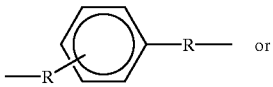

(b)

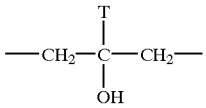

wherein, R indicates a methylene group or an ethylene group, T indicates a hydrogen atom or an alkyl group of carbon number 1 to 4, and $R_4$–$R_9$ independently indicate a halogen atom, an alkyl group of carbon number 1 to 6, or an alkenyl group, further, e, f, g, h, i, j indicate an integer number of 0 to 4 and when are bigger than 2, $R_4$–$R_9$ can be different, and d is an integer of 0 to 10.

9. The thermal recording material of claim 1 wherein 3-di-n-pentylamino-6-methyl-7-anilinofluoran is contained as a basic colorless dye and 4,4'-dihydroxydiphenylsulfone is contained as a dihydroxydiphenylsulfone component.

* * * * *